US005923356A

United States Patent [19]

Gibson et al.

[11] Patent Number: 5,923,356

[45] Date of Patent: Jul. 13, 1999

[54] LIQUID DEVELOPING MATERIAL REPLENISHMENT CONTROL SYSTEM

[75] Inventors: George A. Gibson; James R. Larson, both of Fairport, N.Y.

[73] Assignee: Xerox Corporation, Stamford, Conn.

[21] Appl. No.: 08/551,381

[22] Filed: Nov. 1, 1995

[51] Int. Cl.[6] ..... B41J 2/385; G03G 13/04

[52] U.S. Cl. ..... 347/131; 399/58

[58] Field of Search ..... 347/153, 155, 347/156, 158, 115, 131; 399/53, 58, 48, 57, 27, 233; 358/300; 430/114–119

[56] References Cited

U.S. PATENT DOCUMENTS

| | | | |
|---|---|---|---|
| 4,860,924 | 8/1989 | Simms et al. | 222/56 |
| 4,980,259 | 12/1990 | Landa et al. | 430/117 |
| 5,202,769 | 4/1993 | Suzuki | 358/300 |
| 5,204,698 | 4/1993 | LeSueur et al. | 347/140 |
| 5,231,454 | 7/1993 | Landa | 399/53 |
| 5,349,377 | 9/1994 | Gilliland et al. | 347/131 |

*Primary Examiner*—N. Le
*Assistant Examiner*—L. Anderson
*Attorney, Agent, or Firm*—Kevin R. Kepner

[57] ABSTRACT

An apparatus for developing an electrostatic latent image in a liquid developing material-based electrostatographic printing machine including a control system for controlling an amount of marking particles, carrier liquid and/or charge director added to a supply of liquid developing material utilized for developing a latent electrostatic image such that the concentration of marking particles and or charge director can be maintained at an optimal value. The amount of marking particles, carrier liquid and/or charge director in a supply of liquid developing material is maintained at a predetermined optimal value in response to the amount of marking particles and/or charge director depleted from the supply of liquid developing material with each development cycle. A supply reservoir is maintained with a substantially constant amount of liquid carrier to which is added marking particles and/or charge director to provide an operative solution of liquid developing material. For each development cycle, the amount of marking particles and/or charge director depleted from the supply of liquid developing material is determined as a function of the number of picture elements or pixels making up the image being developed. Marking particles and/or charge director concentrate are added to the supply reservoir to maintain the amount of marking particles and/or charge director in the operative solution of liquid developing material at a predetermined value by effectively supplying the marking particles and/or charge director lost by the transport of liquid developing material to the copy substrate.

26 Claims, 3 Drawing Sheets

LIQUID DEVELOPING MATERIAL REPLENISHMENT CONTROL SYSTEM

FIELD OF THE INVENTION

This invention relates generally to a liquid developing material-based electrostatographic printing machine, and, more particularly, concerns a control system for controlling amounts of individual components making up the liquid developing material to be added to a supply reservoir of the liquid developing material utilized for developing a latent electrostatic image such that the concentration of the individual components of liquid developing material in the supply reservoir can be maintained at an timal value.

BACKGROUND OF THE INVENTION

Generally, the process of electrostatographic copying is initiated by exposing a light image of an original document to a substantially uniformly charged photoreceptive member. Exposing the charged photoreceptive member to a light image discharges the photoconductive surface thereof in areas corresponding to non-image areas in the original input document while maintaining the charge in image areas, resulting in the creation of an electrostatic latent image of the original document on the photoreceptive member. This latent image is subsequently developed into a visible image by a process in which developing material is deposited onto the surface of the photoreceptive member. Typically, this developing material comprises carrier granules having toner particles adhering triboelectrically thereto, wherein the toner particles are electrostatically attracted from the carrier granules to the latent image for forming a powder toner image on the photoreceptive member. Alternatively, liquid developing materials comprising marking particles (or so-called toner solids) and charge directors dispersed in a carrier liquid have been utilized, wherein the liquid developing material is applied to the latent image with the marking particles being attracted toward the image areas to form a developed liquid image. Regardless of the type of developing material employed, the toner or marking particles of the developing material are attracted to the latent image and subsequently transferred from the photoreceptive member to a copy substrate, either directly or by way of an intermediate transfer member. Once on the copy substrate, the image may be permanently affixed to provide a "hard copy" reproduction of the original document or file. In a final step, the photoreceptive member is cleaned to remove any charge and/or residual developing material from the photoconductive surface in preparation for subsequent imaging cycles.

The above described electrostatographic reproduction process is well known and is useful for light lens copying from an original, as well as for printing applications involving electronically generated or stored originals. Analogous processes also exist in other printing applications such as, for example, digital laser printing where a latent image is formed on the photoconductive surface via a modulated laser beam, or ionographic printing and reproduction where charge is deposited on a charge retentive surface in response to electronically generated or stored images. Some of these printing processes develop toner on the discharged area, so-called DAD, or "write black" systems, while other printing processes, such as light lens generated image systems, develop toner on the charged areas, so-called CAD, or "write white" systems. The instant invention applies to systems which implement either of such printing processes.

The use of liquid developing materials in imaging processes is well known. Likewise, the art of developing electrostatographic latent images formed on a photoconductive surface with liquid developing materials is also well known. Indeed, liquid developing material-based systems have been shown to provide many advantages, and generally produce images of higher quality than images formed with dry toners. For example, images developed with liquid developing materials can be made to adhere to paper without a fixing or fusing step, thereby eliminating a requirement to include a resin in the liquid developing material for fusing purposes. In addition, the marking particles used in liquid developing material can be made to be very small without resulting in problems often associated with small particle powder toners, such as airborne contamination which can adversely affect machine reliability and can create potential health hazards. Development with liquid developing materials in full color imaging processes also tends to produce a texturally attractive output document due to minimal multilayer toner height build-up (whereas full color images developed with dry toners often exhibit substantial height build-up of the image in regions where color areas overlap). In addition, full color imaging with liquid developing materials is economically attractive, particularly if surplus liquid carrier containing the toner particles can be economically recovered without cross contamination of colorants. Further, full color prints made with liquid developing materials can be processed to a substantially uniform finish, whereas uniformity of finish is difficult to achieve with powder toners due to variations in the toner pile height as well as a need for thermal fusion, among other factors.

As previously indicated, liquid developing materials generally include a liquid phase, comprising an insulating carrier liquid such as an isoparaffinic hydrocarbon, and a solid phase, comprising marking particles composed of a pigment and a binder, as well as other optional materials, wherein the solid phase marking particles are dispersed or suspended in the liquid phase carrier. In addition, liquid developing materials further include a small amount of charge director for insuring that the marking particles are uniformly charged to the same polarity, either positive or negative depending upon the particular application. Charge director compounds are generally ionic compounds capable of imparting an electrical charge to marking particles of a desired polarity and a uniform magnitude so that the particles may be electrophoretically deposited on a charged surface (e.g., the photoreceptive member). The desired charging is achieved by providing a constant optimum concentration of charge director compound in the developing material liquid. If the liquid developing material contains excessive charge director, the developed images will tend to be somewhat faint due to loss of image charge caused by leakage in the higher conductivity liquid developing material. On the other hand, if the liquid developing material contains an insufficient amount of charge director, the developed images will also tend to be somewhat faint since marking particles having reduced charge move with reduced velocity through the liquid carrier to the imaging surface.

A more serious problem regarding liquid developing materials having insufficient charge director is that the marking particles tend to drop out of suspension, forming sludge deposits which continually grow until operation of the electrostatic copier must be interrupted for cleaning. In some liquid developing materials, it is the maintenance of the charge on the marking particles by the charge director which causes the particles to repel one another, maintaining them in a dispersed state, and preventing them from agglomerating and forming sludge deposits. Thus, stable electrical characteristics in the liquid developing material, in particular the bulk conductivity thereof, are critical in achieving high quality imaging, particularly in high speed, high volume applications. An important factor in determining the electrical characteristics of the liquid developing material, and affecting the electrophoretic development process, is the concentration of the charge director in the liquid carrier. Variation in the charge director concentration is a major problem in liquid developing material-based electrostatographic imaging systems.

In general, when a copy or print is made using liquid developing material, a constant amount of carrier liquid containing an associated amount of liquid phase charge director is deposited over the entire surface of the copy substrate. There is further deposited upon the copy substrate an amount of toner solids or marking particles proportional to the image areas being developed on the copy substrate. The marking particles also include an associated amount of solid phase, charge director and liquid carrier. Accordingly, during the development of a latent image, a first fixed amount of carrier liquid and charge director are depleted from the supply of liquid developing material, along with a second, variable quantity of liquid carrier and charge director associated with the marking particles. The depletion amounts of each of these components depends on the amount of image and non-image areas on the latent image being developed.

The present invention contemplates a liquid developing material control system wherein each individual component of the liquid developing material, namely the liquid carrier, the marking particles, and the charge director compound present in the liquid developing material are maintained at a predetermined optimal value in response to the amount of each component which is depleted from the supply of liquid developing material with each development cycle. Thus, in the present invention, a supply reservoir is maintained with a substantially constant amount of liquid carrier to which is added marking particles and charge director to provide an operative solution of liquid developing material. For each development cycle, the amount of liquid carrier, marking particles, and charge director depleted from the supply of liquid developing material is determined and added to the supply reservoir. More specifically, the amount of marking particles, liquid carrier and charge director depleted during a given development cycle is determined as a function of the number of picture elements or pixels making up the image being developed, for controlling the amount of marking particles, liquid carrier and charge director concentrate to be added to the supply reservoir to maintain an optimal operative solution of liquid developing material. The amount of liquid carrier depleted during a given development cycle is determined as a function of the number of picture elements making up the image being developed in combination with the rate of evaporation of the liquid carrier, for maintaining the amount of liquid carrier in the supply reservoir to maintain an optimal operative solution therein.

The following disclosures may be relevant to some aspects of the present invention:

U.S. Pat. No. 4,860,924
Patentee: Simms et. al.
Issued: Aug. 29,1989
U.S. Pat. No. 5,202,769
Patentee: Suzuki
Issued: Apr. 13,1993
U.S. Pat. 5,204,698
Patentee: LeSueur et. al.
Issued: Apr. 20,1993
U.S. Pat. No. 5,349,377
Patentee: Gilliland et al.
Issued: Sep. 20,1994

The relevant portions of the foregoing patents may be briefly summarized as follows:

U.S. Pat. No. 4,860,924 discloses a copier wherein charge director is supplied to a liquid developer in response to a conductivity measurement thereof. Toner concentrate deficient in charge director is supplied to the liquid developer in response to an optical transmissivity measurement thereof. Conductivity is measured by a pair of spaced electrodes immersed in the developer and through which a variable alternating current is passed. A variable capacitor neutralizes the inherent capacitance of the electrodes. A phase sensitive detector is provided with a reference voltage having the same phase shift as that caused by capacitive effects. The conductivity measurement is corrected in response to a developer temperature measurement.

U.S. Pat. No. 5,202,769 discloses an image output apparatus which includes a circuit for counting the number of pixels of various color and gradation densities contained in the image data, a circuit for estimating, based on the counted number, the amount of toner that will be consumed during development of the image data; and a circuit and rollers for controlling the amount of toner based on the estimated amount and the actual amount of toner supplied for developing the image.

U.S. Pat. No. 5,204,698 discloses in a laser printer, in which a latent image is generated on a circulating imaging member in accordance with digital image signals and subsequently developed with toner, the number of pixels to be toned as an indication of the rate at which toner is being depleted from the developer mixture. The device for dispensing fresh toner to the developer mixture is operated in dependence on the number of pixels to be toned so that there is a pre-established relationship between the pixel count and the length of time for which the dispensing device is in operation. If the efficiency of the dispensing device falls, the pre-established relationship is adjusted so that the toner density in the developed images remains constant. If a predetermined level of adjustment is reached, it is taken as an indication that the supply of toner in the printer is low, and should be replenished.

U.S. Pat. No. 5,349,377 discloses an improved system for more accurately estimating consumption of toner imaging material in a digital xerographic printer in relation to a count of the digital pixels generating the various images being printed, where the frequency rates of the switching between print and non-print pixels are analyzed to provide weighting factors corresponding to different types of images being printed which affect the consumption of imaging material by the printer, and the pixel counts are weighted by these weighting factors to provide an imaging material consumption calculation based on image types as well as image pixel counts. The pixel count weighting factor is automatically substantially increased for the higher print/nonprint rates, or pixel on/off frequencies, and higher toner consumption by fringe field development, corresponding to halftone images in comparison to solid area images. The pixel count weighting factor is intermediately increased for intermediate imaging frequencies corresponding to normal line text.

SUMMARY OF THE INVENTION

In accordance with one aspect of the present invention, there is provided a liquid developing material-based electrostatographic printing machine, comprising: means for generating a digital data signal representing individual picture elements making up an input image to produce a latent electrostatic image on an imaging surface; means for developing the electrostatic latent image on the imaging surface with a liquid developing material comprising a plurality of liquid developing material components; means for counting the number of picture elements contained in the digital data signal; means, responsive to the counting means, for determining an amount of at least one of the plurality of liquid developing material components consumed in developing the latent electrostatic image; and means, responsive to the determining means, for controlling an amount of the at least one of the plurality of liquid developing material components to be added to the liquid developing material.

In accordance with another aspect of the present invention, an electrostatographic printing apparatus is provided, comprising: a digital image processing system for generating digital signals corresponding to individual picture elements making up an input image to produce a latent electrostatic image on an image bearing surface; a liquid developing system for developing the electrostatic latent image on the imaging member with a liquid developing material comprising a plurality of liquid developing material components; and a liquid developing material replenishment control system for determining an amount of at least one of the plurality of liquid developing material components consumed in developing the latent electrostatic image as a function of a number of the individual picture elements making up the input image and for controlling an amount of the at least one of the plurality of liquid developing material components to be added to the liquid developing material as a function of the number of the individual picture elements making up the input image.

In accordance with another aspect of the present invention, there is provided an apparatus for developing an electrostatic latent image on an image bearing surface with a liquid developing material including a plurality of liquid developing material components, comprising: a digital image processing system for generating digital signals corresponding to individual picture elements making up an input image to produce a latent electrostatic image on an image bearing surface; and a liquid developing material replenishment control system for determining an amount of at least one of the plurality of liquid developing material components consumed in developing the latent electrostatic image as a function of a number of the individual picture elements making up the input image and for controlling an amount of the at least one of the plurality of liquid developing material components to be added to the liquid developing material as a function of the number of the individual picture elements making up the input image.

In accordance with another aspect of the present invention, electrostatographic printing process is disclosed, comprising the steps of: generating a digital data signal representing individual picture elements making up an input image to produce a latent electrostatic image on an imaging surface; applying a liquid developing material to the imaging surface for developing the latent electrostatic image, the liquid developing material including a plurality of liquid developing material components; counting the number of picture elements contained in the digital data signal; determining an amount of at least one of the plurality of liquid developing material components consumed in said developing step as a function of the number of picture elements making up the latent electrostatic image; and dispensing a selected amount of the at least one of the plurality of liquid developing material components into the liquid developing material in response to the counting step.

In accordance with yet another aspect of the present invention, an imaging method is disclosed, comprising the steps of: developing a latent electrostatic image made up of a plurality of individual picture elements with a liquid developing material including a carrier liquid having dispersed therein marking particles and a charge director compound; and dispensing a selected amount of marking particles, liquid carrier and/or charge director into the liquid developing material in response to a number of the plurality of individual picture elements making up the latent electrostatic image.

Other aspects of the present invention will become apparent as the following description proceeds and upon reference to the drawings, in which:

DETAILED DESCRIPTION OF THE INVENTION

Figure 3:
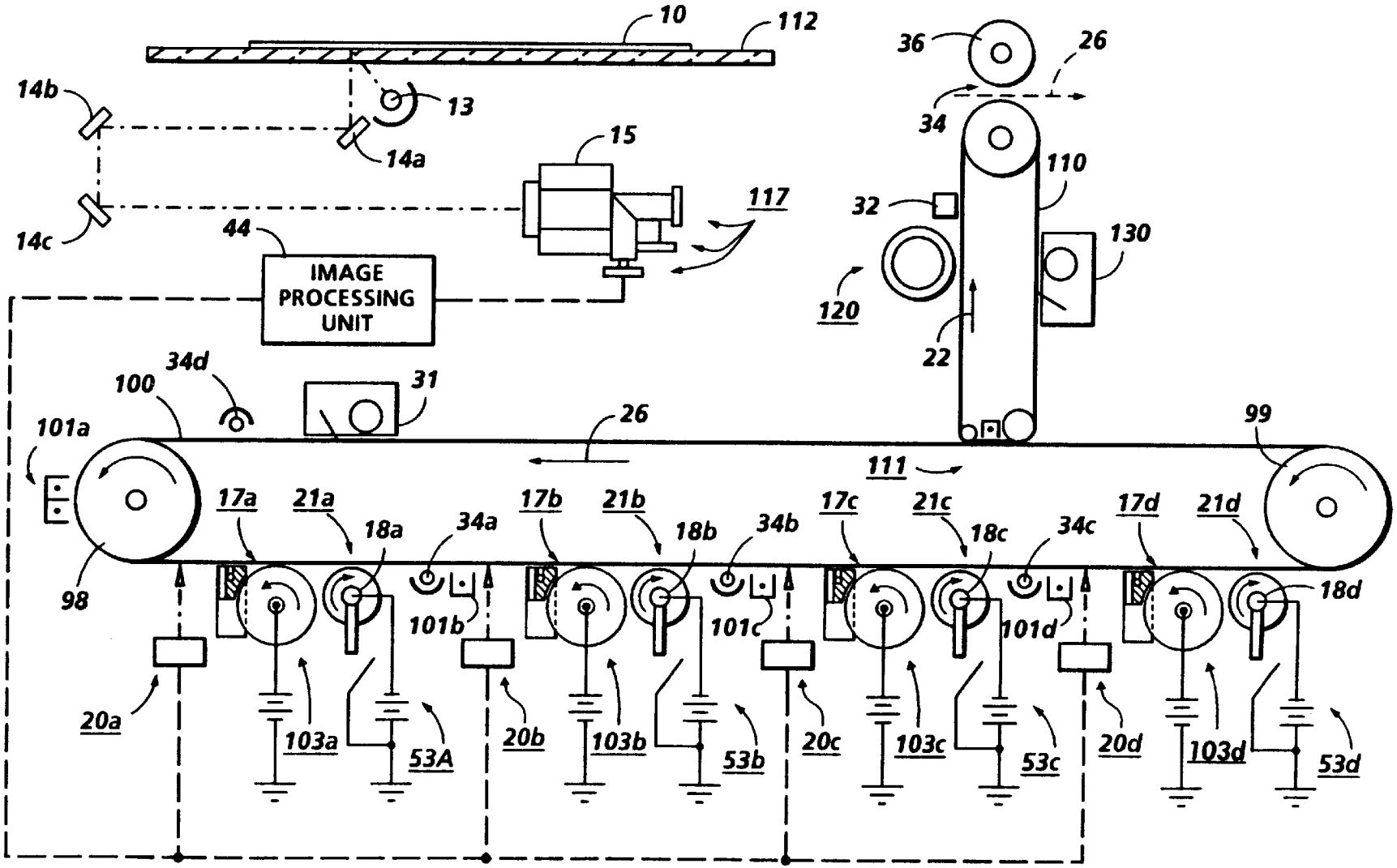
FIG. 3 is a schematic, elevational view of a color electrostatographic printing machine incorporating a liquid developing material replenishment control system in accordance with the present invention.

For a general understanding of the features of the present invention, reference is made to the drawings, wherein like reference numerals have been used throughout to designate identical elements. FIG. 3 is a schematic elevational view illustrating a full-color liquid developing material-based electrostatographic printing machine incorporating the features of the present invention. Inasmuch as the art of electrostatographic printing is well known, the various processing stations employed in the printing machine of FIG. 3 will be described briefly with reference thereto. It will become apparent from the following discussion that the apparatus of the present invention may be equally well suited for use in a wide variety of printing machines and is not necessarily limited in its application to the particular electrostatographic machine described herein. Moreover, while the present invention will hereinafter be described in connection with a preferred embodiment thereof, it will be understood that the description of the invention is not intended to limit the invention to this preferred embodiment. On the contrary, the description is intended to cover all alternatives, modifications, and equivalents as may be included within the spirit and scope of the invention as defined by the appended claims.

Turning now to FIG. 3, a photoreceptive member 100 is rotated along a curvilinear path defined by rollers 98 and 99. The photoreceptor 100 preferably includes a continuous multilayered belt including a substrate, a conductive layer, an optional adhesive layer, an optional hole blocking layer, a charge generating layer, a charge transport layer, and, in some embodiments, an anti-curl backing layer. Initially, belt 100 is charged to a uniform potential at a charging station by charging unit 101*a,* which typically includes a corona generating device capable of spraying ions onto the surface of the photoreceptive member 100 to produce a relatively high, substantially uniform charge thereon.

After a uniform charge is placed on the surface of the photoreceptive member 100, the electrostatographic printing process proceeds by either providing a computer generated image input into an image processing unit 44 or, for example, by placing an input document 10 onto the surface of a transparent imaging platen 112 for copying thereof. A scanning assembly, preferably comprising a high powered light source 13, mirrors 14*a,* 14*b* and 14*c,* a series of lenses (not shown), a dichloric prism 15 and a plurality of charge-coupled devices (CCDs) 117, operating in association with one another, scans the input document, whereby light from the light source 13 is directed onto the input document 10 with the light reflected from the color document 10 being transmitted to the CCDs 117. The reflected light is separated into the three primary colors by the dichroic prism 15 such that each CCD 117 provides an analog output voltage which is proportional to the intensity of the incident light of each of the primary colors. Thereafter, the analog signal from each CCD 117 is converted into a digital signal corresponding to individual picture elements or so-called pixels making up the original input document. These digital signals, which represent the blue, green, and red density levels of the input image, are input into the image processing unit 44 where individual bitmaps representing the color components of each pixel (yellow (Y), cyan (C), magenta (M), and black (Bk)) are generated, as well as the respective values of exposure for each pixel, and the color separation therebetween. The image processing unit 44 can operate in a real time mode or can store bitmap information for subsequent images. The image processing unit 44 may also contain a shading correction unit, an undercolor removal unit (UCR), a masking unit, a dithering unit, a gray level processing unit, and other imaging processing sub-systems and/or circuitry as known in the art.

The digital output signals generated by the image processing unit 44 described hereinabove are transmitted to a series of individual raster output scanners (ROSs) 20*a,* 20*b,* 20*c* and 20*d* for writing complementary color image bitmap information onto the charged photoreceptive belt 100 by selectively erasing charges thereon. Each ROS writes the image information in a pixel by pixel manner. It will be recognized that the present description is directed toward a Recharge, Expose, and Develop (REaD) process, wherein the charged photoconductive surface of photoreceptive member 100 is serially exposed to record a series of latent images thereon corresponding to the subtractive color of one of the colors of the appropriately colored toner particles at a corresponding development station. Thus, the photoconductive surface is systematically recharged and re-exposed to record latent images thereon corresponding to the subtractive primary of another color of the original. These latent images are subsequently serially developed, as will be described, with appropriately colored toner particles until all the different color toner layers are deposited in superimposed registration with one another on the photoconductive surface. It should be noted that either discharged area development (DAD) wherein discharged portions are developed, or charged area development (CAD), wherein charged areas are developed, can be employed, as will be described.

Figure 1:
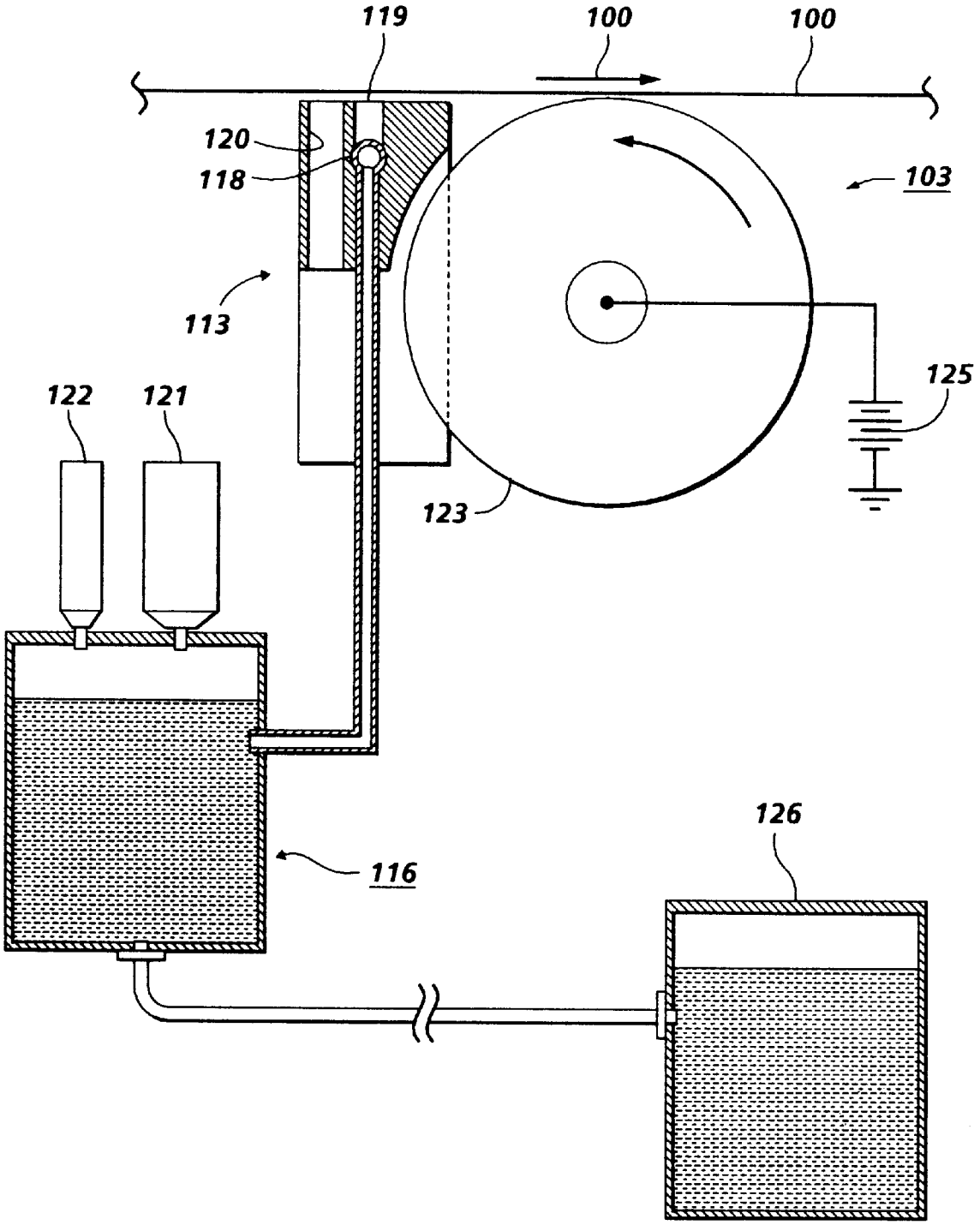
FIG. 1 is a schematic, elevational view of an exemplary liquid developing material applicator and an exemplary liquid developing material development system incorporating a liquid developing material replenishment control system in accordance with the present invention therein.

An exemplary apparatus for carrying out the development process utilizing liquid developing materials is depicted schematically at reference numerals 103*a,* 103*b,* 103*c* and 103*d,* with an individual development apparatus being shown in greater detail in FIG. 1. Each developer unit 103 transports a different color liquid developing material into contact with the electrostatic latent image on the photoreceptor surface so as to develop the latent image with pigmented toner particles to create a visible image. By way of example, developer unit 103*a* transports cyan colored liquid developer material, developer unit 103*b* transports magenta colored liquid developer material, developer unit 103*c* transports yellow colored liquid developer material, and developer unit 103*d* transports black colored liquid developer material. Each different color liquid developing material comprises pigmented toner particles and charge directors disseminated through a liquid carrier, wherein the toner particles are charged to a polarity opposite in polarity to the charged latent image on the photoconductive surface such that the toner particles pass by electrophoresis to the electrostatic latent image to create a visible developed image thereof. Each of the developer units 103*a,* 103*b,* 103*c* and 103*d* are substantially identical to one another and represent one of various known apparatus that can be utilized to apply liquid developing material to the photoconductive surface.

After image development, the liquid image on the photoconductor may be conditioned to compress the image and remove some of the liquid carrier therefrom, as shown, for example, by U.S. Pat. No. 4,286,039, among various other patents. An exemplary apparatus for image conditioning is shown at reference numeral 21*a,* 21*b,* 21*c* and 21*d,* each comprising a roller, similar to roller 18*a* which may include a porous body and a perforated skin covering. The roller 18*a* is typically biased to a potential having a polarity which inhibits the departure of toner particles from the image on the photoreceptor 100 while compacting the toner particles of the image onto the surface of the photoreceptive member. In this exemplary image conditioning system, a vacuum source (not shown) is also provided and coupled to the interior of the roller for creating an airflow through the porous roller body to draw liquid from the surface of the photoreceptor, thereby increasing the percentage of toner solids in the developed image. In operation, roller 18*a* rotates against the liquid image on belt 100 such that the porous body of roller 18*a* absorbs excess liquid from the surface of the image through the pores and perforations of the roller skin covering. The vacuum source, typically located along one end of a central cavity, draws liquid through the roller skin to a central cavity for depositing the liquid in a receptacle or some other location which permits either disposal or recirculation of the liquid carrier. The porous roller 18*a* is thus continuously discharged of excess liquid to provide continuous removal of liquid from the image on belt 100. It will be recognized by one of skill in the art that the vacuum assisted liquid absorbing roller described hereinabove may also find useful application in an embodiment in which the image conditioning system is provided in the form of a belt, whereby excess liquid carrier is absorbed through an absorbent foam layer in the belt, as described in U.S. Pat. Nos. 4,299,902 and 4,258,115.

After image conditioning of the first developed image, the image on belt 100 is advanced to a lamp 34*a* where any residual charge left on the photoreceptive surface is extinguished by flooding the photoconductive surface with light from lamp 34*a*. Thereafter, imaging and development are repeated for subsequent color separations by first recharging and reexposing the belt 100, whereby color image bitmap information is superimposed over the previous developed latent image. Preferably, for each subsequent exposure an adaptive exposure processor is employed that modulates the exposure level of the raster output scanner (ROS) for a given pixel as a function of the toner previously developed at the pixel site, thereby allowing toner layers to be made independent of each other, as described in U.S. application Ser. No. 07/927,751. The reexposed image is next advanced through a development station and subsequently through an image conditioning station and each step is repeated as previously described to create a multi layer image made up of black, yellow, magenta, and cyan toner particles as provided via each developing station 103*a,* 103*b,* 103*c* and 103*d.* It should be evident to one skilled in the art that the color of toner at each development station could be in a different arrangement.

After the multi layer image is created on the photoreceptive member, it may be advanced to an intermediate transfer station where charging device 111 generates a charge for electrostatically transferring the image from the photoconductive belt 100 to an intermediate transfer member 110. The intermediate member 110 may be in the form of either a rigid roll or an endless belt, as shown in FIG. 3, having a path defined by a plurality of rollers in contact with the inner surface thereof. The intermediate member preferably comprises a multilayer structure comprising a substrate layer having a thickness greater than 0.1 mm and a resistivity of about $10^6$ ohm-cm and insulating top layer having a thickness less than 10 micron, a dielectric constant of approximately 10, and a resistivity of about $10^{13}$ ohm-cm. The top layer also has an adhesive release surface. It is also preferred that both layers have a similar hardness of less than about 60 durometer. Preferably, both layers are composed of Viton™ (a fluoroelastomer of vinylidene fluoride and hexafluoropropylene) which can be laminated together. The intermediate transfer member is typically dimensionally stable in nature for providing uniform image deposition which results in a controlled image transfer gap and better image registration.

The multi layer image on the intermediate transfer member 110 may be image conditioned in a manner similar to the image conditioning described hereinabove with respect to the developed image on the photoconductive belt 100 by means of a roller 120 which conditions the image by reducing fluid content while inhibiting the departure of toner particles from the image as well as compacting the toner image. Preferably, roller 120 conditions the multi layer image so that the image has a toner composition of more than 50 percent solids. In addition, the multi layer image present on the surface of the intermediate member may be transformed into a tackified or molten state by heat, as may be provided by a heating element 32. More specifically, heating element 32 heats both the external wall of the intermediate member and generally maintains the outer wall of member 110 at a temperature sufficient to cause the toner particles present on the surface to melt, due to the mass and thermal conductivity of the intermediate member. The toner particles on the surface maintain the position in which they were deposited on the outer surface of member 110, so as not to alter the image pattern which they represent while softening and coalescing due to the application of heat from the exterior of member 110. Thereafter, the intermediate transfer member continues to advance in the direction of arrow 22 to a transfix nip 34 where the tackified toner particle image is transferred, and bonded, to a recording sheet 26 with limited wicking thereby. At the transfix nip 34, the toner particles are forced into contact with the surface of recording sheet 26 by a normal force applied through backup pressure roll 36. Some of the advantages provided by the use of an intermediate transfer member include reduced heating of the recording sheet as a result of the toner or marking particles being pre-melted on the intermediate, as well as the elimination of an electrostatic transfer device for transferring charged particles to a recording sheet.

After the developed image is transferred to intermediate member 110, residual liquid developer material may remain on the photoconductive surface of belt 100. A cleaning station 31 is therefore provided, including a roller formed of any appropriate synthetic resin which may be driven in a direction opposite to the direction of movement of belt 100, to scrub the photoconductive surface clean. It will be understood, however, that a number of photoconductor cleaning devices exist in the art, any of which would be suitable for use with the present invention. In addition, any residual charge left on the photoconductive surface may be extinguished by flooding the photoconductive surface with light from lamp 34*d* in preparation for a subsequent successive imaging cycle. In this way, successive electrostatic latent images may be developed.

The various operations described hereinabove are preferably carried out under the control of a generally conventional microprocessor based control unit (not shown). Such a control unit is programmed with certain novel functions and graphical user interface features for the general operation of the electrostatographic printing system including, in particular, all document handler, xerographic imaging, sheet feeding and finishing operations. Updated data and status information is continually communicated to the control unit for keeping track of, and initiating changes in, the various operative components of the printing apparatus so that all machine functions described herein, including imaging onto the photoreceptor, xerographic functions associated with developing the image and transferring the developed image onto paper, paper transport, and finishing operations may be automatically controlled. It will be understood that the control unit is integral to the pixel counting and developing material replenishment control system of the present invention.

The foregoing discussion provides a general description of the operation of a liquid developing material-based electrostatographic printing machine. The detailed structure of an exemplary development apparatus will be described hereinafter with reference to FIG. 1. It will be understood that this exemplary development system may take many forms, as for example, described in U.S. Pat. Nos. 4,733,273; 4,883,018; and 5,355,201 among others, and may be utilized in a multicolor electrophotographic printing machine or, in a monocolor printing machine. Multicolor printing machines may use this type of development unit wherein successive latent images are developed to form a composite multicolor toner image which is subsequently transferred to a copy sheet or wherein single color liquid images may be transferred in superimposed registration with one another directly to the copy sheet. The developed image may be transferred to an intermediate member prior to transfer to the copy sheet, as described hereinabove, or, in the alternative, may be transferred directly to the copy sheet.

Referring now to FIG. 1, an exemplary developer system 103 will be described with an understanding that the developer units 103*a,* 103*b,* 103*c* and 103*d* shown, and generally described with respect to the apparatus of FIG. 3, are substantially identical thereto. In general, the only distinction between each developer unit is the color of the liquid developing material being used. As depicted in FIG. 1, the developer system 103 includes a developing material applicator 113 coupled to a developing material supply reservoir 116 as well as a metering roll 123 situated adjacent to the applicator 113 and in close proximity to the surface of photoreceptive belt 100. Supply reservoir 116 acts as a storage tank for storing an operative solution of liquid developing material comprised of liquid carrier, marking particles and charge director to be delivered to the developing material application 113. Containers of concentrated marking particles and charge directors, indicated respectively by reference numerals 121 and 122, are typically provided in association with each supply reservoir 116. In addition, a carrier liquid supply source 126 is also coupled to the supply reservoir 116 for maintaining the amount of carrier liquid therein at a substantially constant level.

The exemplary developing material applicator 113 includes an elongated aperture 119 extending along a longitudinal axis of the housing so as to be oriented substantially transverse to the surface of photoreceptor belt 100, along the direction of travel thereof (as indicated by arrow 26). The aperture 119 provides a path of travel for liquid developing material being transported therethrough and also defines a developing material application region in which the liquid developing material can freely flow in order to contact the surface of the photoreceptor belt 100 for developing the latent image thereon. Thus, liquid developing material is pumped from the supply reservoir 116 to the applicator 113 through at least one inlet port 118, such that the liquid developing material flows out of the elongated aperture 119 and into contact with the surface of photoreceptor belt 100. An overflow drainage channel (not shown) partially surrounds the aperture 119 for collecting excess developing material which may not have been transferred over to the photoreceptor surface. The overflow channel is connected to an outlet port 120 for removal of excess or extraneous liquid developing material and, preferably, for directing this excess material to a sump whereat the liquid developing material can be collected and the individual components thereof can be recycled for subsequent use.

Slightly downstream of and adjacent to the developing material applicator 113, in the direction of movement of the photoreceptor surface 100, is an electrically biased developer roller 123, the peripheral surface thereof being situated in close proximity to the surface of the photoreceptor 100. The developer roller 123 rotates in a direction opposite the movement of the photoconductor surface 100 so as to apply a substantial shear force to the thin layer of liquid developing material present in the area of the nip between the developer roller 123 and the photoreceptor 100, for minimizing the thickness of the liquid developing material on the surface thereof. This shear force removes a predetermined amount of excess liquid developing material from the surface of the photoreceptor and transports this excess developing material in the direction of the developing material applicator 113. The excess developing material eventually falls away from the rotating metering roll for collection in the sump, as previously described. A DC power supply 125 is also provided for maintaining an electrical bias on the metering roll 123 at a selected polarity such that image areas of the electrostatic latent image on the photoconductive surface attracts toner for developing the electrostatic latent image. This electrophoretic development process minimizes the existence of marking particles in background regions and maximizes the deposit of marking particles in image areas on the photoreceptor.

In operation, liquid developing material is pumped through inlet ports 118 into the elongated aperture 119. The developing material flows in the direction of the photoreceptor 100, filling the gap between the surface of the photoreceptor and the liquid developing material applicator 113. As the belt 100 moves in the direction of arrow 26, a portion of the liquid developing material moves therewith in the direction of the metering roll 123. The metering roll is biased via the DC power supply 125, causing toner particles in the developer material to be attracted to the electrostatic latent image on the photoreceptor. The developing roller 123 also meters a predetermined amount of liquid developing material adhering to the photoconductive surface of belt 100 and acts as a seal for transporting extraneous liquid developing material away from the photoreceptor.

As previously indicated, the liquid developing material generally comprises marking particles and charge directors dispersed in a liquid carrier medium, with an operative solution of the developing material being stored in supply tank 116. Generally, the liquid carrier medium is present in a large amount in the developing material composition, and constitutes that percentage by weight of the developer not accounted for by the other components. The liquid medium is usually present in an amount of from about 80 to about 98 percent by weight, although this amount may vary from this range provided that the objectives of the present invention are achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, pk Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures.

The marking or so-called toner particles can be any pigmented particle compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and 5,451,483, among others, the disclosures of each of which are totally incorporated herein by reference. Preferably, the toner particles should have an average particle diameter ranging from about 0.2 to about 10 microns, and most preferably between about 0.5 and about 2 microns. The toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

As previously discussed, in addition to the liquid carrier vehicle and toner particles which typically make up the liquid developer materials, a charge director (sometimes referred to as a charge control additive) is also provided for facilitating and maintaining a uniform charge on the marking particles in the operative solution of the liquid developing material by imparting an electrical charge of selected polarity (positive or negative) to the marking particles. Examples of suitable charge director compounds include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

The application of liquid developing material to the photoconductive surface via applicator 113, or by any other liquid development system, clearly depletes the overall amount of the operative solution of developing material stored in supply reservoir 116. Marking particles are depleted in the image areas; carrier liquid is depleted in the image areas (trapped by toner) and in background areas, and may also be depleted by evaporation; and charge director is depleted in the image areas in the trapped carrier liquid, in the image areas adsorbed onto marking particles, and in the background areas. In practice, the supply reservoir 116 is continuously replenished, as necessary, by the addition of liquid carrier, marking particles, and/or charge director into the supply reservoir 116. However, because the total amount of any one of these materials making up the liquid developing material utilized to develop the image varies as a function of the area of the developed image areas and background portions of the latent image on the photoconductive surface, the specific amount of each of these components of the liquid developing material which must be added to the supply reservoir 116 varies with each development cycle. That is, a developed image having a large proportion of printed image area or having substantially a single color will cause a greater depletion of marking particles and/or charge director in the liquid developing material supply tank as compared to a developed image with a small amount of printed image area or of a single color. Thus, while the rate of the replenishment of the liquid carrier component of the liquid developing material may be controlled by simply monitoring the level of liquid developer in the supply reservoir 116, as previously described, the rate of replenishment of the marking particles, and/or the charge director components of the liquid developing material must be controlled in a more sophisticated manner to maintain a predetermined concentration of the marking particles and the charge director in the operative solution stored in the supply reservoir 116. Moreover, if additional information regarding the rate of evaporation of the liquid carrier is provided, the amount of liquid carrier depleted during a given development cycle may also be determined as a function of the number of picture elements making up the image being developed.

In accordance with the present invention, the rate of replenishment of marking particles and/or charge director is controlled in the machine of FIG. 3 by dispensing marking particles and/or charge director to the supply reservoir 116 of FIG. 1 in proportion with the number of pixels developed in a given development cycle. This proportional analysis and control is provided with each image cycle and for each color separation making up the image such that a pixel count is provided for each image and each color separation, thereby operating effectively as an assessment of the extent of depletion of the marking particles and the charge director in a developed image area for each developer housing 103*a*, 103*b*, 103*c* and 103*d*. Thus, by the present invention, for every development cycle of each color development system, the number of pixels making up the image for that color and cycle is monitored and the result is processed by the machine microprocessor to determine the amount of marking particles and/or charge director to be added to the supply reservoir 116. It will be recognized by those of skill in the art that the amount of liquid carrier depleted during a given development cycle may also be determined as a function of the number of picture elements making up the image being developed if additional information regarding the rate of evaporation of the liquid carrier is provided. Thus the present invention may also be useful for maintaining the amount of liquid carrier in the supply reservoir to maintain an optimal operative solution therein.

Figure 2:
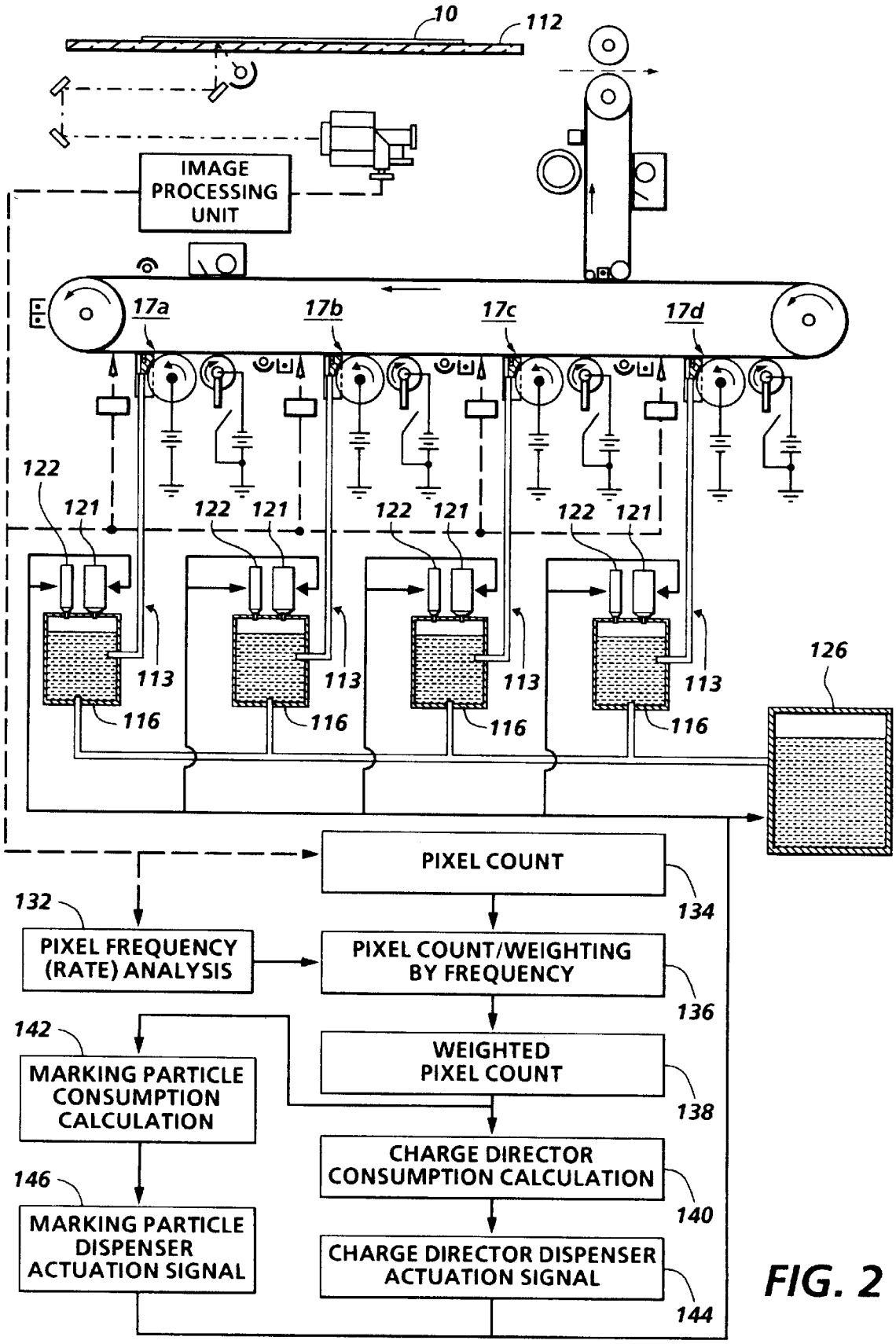
FIG. 2 is a combination schematic view of an electrostatographic printing machine and a flow chart of an exemplary liquid developing material replenishment control system in accordance with the present invention.

One procedure for providing control of the dispensing of marking particles and/or charge director in response to pixel count is summarized in FIG. 2. It will be understood that the sophistication with which the image is analyzed can affect the overall effectiveness of the liquid developing material replenishment control system. For example, it is known that halftones and gray scales, where subpixels are turned "on" and "off" at a high frequency, consume substantially greater amounts of marking particles and charge director than a solid image area due to so called "fringe field" development effects adjacent to the edges of each of the image areas. By contrast, in the case of solid image areas, the frequency at which pixels and subpixels are turned on and off will be effectively zero, because the imaging pixel is constantly "on" for the duration of the scan line of the solid area. Similarly, the frequency for text or lines will be somewhere between these two frequency extremes over some range. Thus, a procedure that accounts for edge effects in the developed image, or the difference between half toned and solid image areas may improve the precision of the pixel count calculation, and therefore, may enhance the effectiveness of the control system. As such, it will be understood that the following description of a procedure for providing charge director control is intended to be illustrative in nature and should not be construed as a limiting feature of the invention which is directed toward a system for controlling marking particles and/or charge director quantities in an operative solution of liquid developing material as a function of pixel count in the developed image. Any of various types of pixel counting procedures may be utilized in accordance with the present invention as, for example, disclosed in U.S. Pat. Nos. 3,409,901; 4,468,112; 4,847,659;

4,908,666; 5,204,698; and 5,204,699, to name a few, as well as prior art cited therein, all of which are incorporated by reference herein.

Referring to FIG. 2, a schematic view and flowchart of one exemplary printer imaging material usage calculation system in accordance with the present invention will be described wherein the signal generated by the image processing unit 44, which generates the image to be printed in an electronic pixel (or bit) stream format, is tapped for pixel counting purposes 134 as well as for frequency or rate analysis 132. By monitoring the frequency of "on" or "off" bits in a raster line (or other selected time period or image area) for each color separation, a determination can be made as to what type of image is being exposed on the photoreceptor. It will be understood that "on" bits refer here the imaging pixels corresponding to the smallest spot or mark that the laser beam will print. However, it will also be understood that the present invention may operate in conjunction with a "write white" printing system, wherein the "off" bits refer to the imaging pixels. After a determination of appropriate frequency ranges for the different image types, a weighting factor for usage or depletion is assigned to each image type. As will be seen from the following discussion, this procedure will provide a pixel count 134 as well as an assigned weighting factor 136 for generating a weighted pixel count 138 which will, in turn, be utilized to calculate an estimate of marking particle and/or charge director consumption 140, 142 to generate a dispenser actuation signal 144, 146 for dispensing the appropriate amount of marking particle and/or charge director to be added to the operative solution of liquid developing material in each supply reservoir 116 as each image is developed. Once again, it is noted that the amount of liquid carrier depleted during a given development cycle may also be determined as a function of the number of picture elements making up the image being developed if additional information regarding the rate of evaporation of the liquid carrier is provided such that the pixel counting scheme of the present invention may also be useful for maintaining the amount of liquid carrier in the supply reservoir to maintain an optimal operative solution therein.

The following are examples of how weighting factors by frequency which can be assigned. A weight of unity, or "1" can be assigned for a pixel on/off frequency of less than X per line scan (or some unit of time), a 1.x weight for a frequency of between X and Y per line and a higher 1.y weight for a higher frequency of Y or greater per line, etc. This weighting, once assigned, can be stored and retrieved by a simple look-up table or simple program in the existing printer microprocessor controller, or other chip, e.g., simply counting the total number of "on/off" pixel changes in each raster scan time (or other selected time period) for sampling as the "frequency." Since an "end-of-line" signal and a time delay between each such raster scan is typically provided, the existing raster scan (one laser line scan or sweep, or one LED bar line set of signals) is suitable for use as the frequency sampling rate, to thus define a known sampling period within which the number of on to off or write to not write transition signals can be counted for determining their frequency. The total number of image pixels can also be counted between the same end-of-line signals, and weighted by the former as taught herein. This weighted count can also be buffered or stored, line by line. Additionally, line by line comparison of vertically adjacent pixels can be weighted using the same algorithms as for horizontal pixels, to provide better precision, typically at a greater cost. Conventionally, this count can be divided or rounded off to higher significant digits, or averaged over several lines to conserve on memory. An additional weighting factor input could be the developer system voltage bias level, typically set by operator controls for "copy lighter/copy darker", or the like, which settings, if frequently used, and/or not promptly default reset to normal, can also affect the marking particle and the charge director consumption rate.

With respect to the more sophisticated pixel weighting procedure introduced above, the actual pixel weighting factors will vary with the particular printer, and should be experimentally and empirically determined by counting pixels and measuring usage of marking particle and/or charge director for different images in a test machine of that type (under conditions of suitable area image coverage and density). That is, the "fringe-field" effect will vary with different printers due to differences in the photoreceptor, its charge/discharge levels, the development and developer bias level system, the liquid developing material, etc.. Also, the frequency of the pixel rate for any given image may vary between printers due to differences in the imager spot size and spacing or resolution (pixels per centimeter) and the scanning rate (the sweep rate of the laser beam or on/off rate and LED spacing of the LED image bar).

Although pixel frequency sampling and pixel weighting and counting could be accomplished via hard-wired buffers, counters and/or timers, the use of a conventional software controlled microprocessor is preferred, as noted above. An appropriate microprocessor program which will enable the machine control unit to carry out the above procedure can be provided on the basis of the above description, having regard to the particular machine in which the procedure is to be implemented. The system disclosed herein can provide substantial hardware cost savings, and repair or maintenance cost savings, as compared to other sensor-based systems which typically require optical, sonic, torque, weight or other sensors which are immersed in the supply reservoir, as well as associated wiring and the like.

The use of a pixel count, whether weighted or not, to regulate the marking particle, carrier liquid and/or charge director dispensing system enables the machine to respond rapidly to changes in depletion rates from one photoreceptor cycle to another as well as one color development station to another. The pixel count signal, indicating area coverage for each image and for each color separation of each image, can be made available as liquid developing material is being dispensed, and before the need to dispense marking particle and/or charge director becomes apparent from the quality of the developed images. The control system of the present invention can also be used for providing an indication to the machine operator that the supply of marking particles, liquid carrier and/or charge director is low or depleted, leading to improved system management and enhanced system stability. Thus, as each page is printed, the corresponding marking particle, carrier liquid and/or charge director consumption can be calculated and subtracted from the previously calculated remaining balance to provide some indication to the customer that the marking particle and/or charge director supply is empty and should be replaced.

It will be appreciated that the procedure described above, and illustrated in FIG. 2, is not restricted to use only in a printer of the type illustrated in FIG. 3. A similar procedure could be applied to other printers and digital copiers in which advance information is available on the extent of the image pixels making up an image to be printed. Also, although the present invention has been described in connection with a color liquid developer-based xerographic system, this subject system may also be usable for ionographic printing or the like. In addition, and as previously recognized, the amount of liquid carrier depleted during a given development cycle may be determined as a function of the number of picture elements making up the image being developed in combination with information regarding the rate of evaporation of the liquid carrier such that the amount of liquid carrier in the supply reservoir can also be maintained at an optimal level through the use of the concept of the present invention.

It is, therefore, apparent that there has been provided, in accordance with the present invention, a liquid developing material replenishment control system, wherein the charge director compound, carrier liquid and/or marking particles present in the liquid developing material is maintained at a predetermined optimal value in response to the amount of any of these components of the liquid developing material is depleted from the supply thereof, determined as a function of the number of picture elements or pixels making up the image being developed. This apparatus fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

We claim:

1. A liquid developing material-based electrostatographic printing machine, including a control system, comprising:

means for generating a digital data signal representing individual picture elements making up an input image to produce a latent electrostatic image on an imaging surface; means for developing the electrostatic latent image on the imaging surface with a liquid developing material comprising a plurality of liquid developing material components;

means for counting the number of picture elements contained in the digital data signal;

means, responsive to said counting means, for determining an amount of at least one of the plurality of liquid developing material components consumed in developing the latent electrostatic image; and means, responsive to said determining means, for controlling an amount of the at least one of the plurality of liquid developing material components to be added to the liquid developing material.

2. The liquid developing material-based electrostatographic printing machine of claim 1, wherein:

the plurality of liquid developing material components includes at least a liquid carrier, marking particles, and charge director; and the at least one of the plurality of liquid developing material components includes the charge director.

3. The liquid developing material-based electrostatographic printing machine of claim 1, wherein:

the plurality of liquid developing material components includes at least a liquid carrier, marking particles, and charge director; and the at least one of the plurality of liquid developing material components includes the marking particles.

4. The liquid developing material-based electrostatographic printing machine of claim 3, wherein the at least one of the plurality of liquid developing material components further includes the charge director.

5. The liquid developing material-based electrostatographic printing machine of claim 1, wherein:

said generating means includes means for determining a color value for each picture element; and said counting means includes means, responsive to said means for determining a color value for each picture element, for determining a color picture element count corresponding to each color value.

6. The liquid developing material-based electrostatographic printing machine of claim 1, wherein said determining means includes means for analyzing frequency rates of the individual picture elements as a function of switching between print and non-print picture elements to provide a weighting factor to be applied to said counting means, thereby providing a more accurate determination of the amount of the charge director consumed in developing the latent electrostatic image.

7. An electrostatographic printing apparatus, comprising:

a digital image processing system for generating digital signals corresponding to individual picture elements making up an input image to produce a latent electrostatic image on an image bearing surface;

a liquid developing system for developing the electrostatic latent image on the image bearing surface with a liquid developing material comprising a plurality of liquid developing material components;

a liquid developing material replenishment control system for determining an amount of at least one of the plurality of liquid developing material components consumed in developing the latent electrostatic image as a function of a number of the individual picture elements making up the input image and for controlling an amount of the at least one of the plurality of liquid developing material components to be added to the liquid developing material as a function of the number of the individual picture elements making up the input image.

8. The electrostatographic printing apparatus of claim 7, wherein said liquid developing system includes:

a liquid developing material applicator adapted for transporting liquid developing material into contact with the image bearing surface; and a supply reservoir coupled to said liquid developing material applicator for storing a supply of the liquid developing material and delivering the liquid developing material to said liquid developing material applicator.

9. The electrostatographic printing apparatus of claim 8, further including means, responsive to said control system, for dispensing at least one of the plurality of liquid developing material components into said supply reservoir.

10. The electrostatographic printing apparatus of claim 9, wherein:

the plurality of liquid developing material components includes at least a liquid carrier, marking particles, and charge director; and the at least one of the plurality of liquid developing material components includes the charge director.

11. The electrostatographic printing apparatus of claim 9, wherein:

the plurality of liquid developing material components includes at least a liquid carrier, marking particles, and charge director; and the at least one of the plurality of liquid developing material components includes the marking particles.

12. The electrostatographic printing apparatus of claim 11, wherein the at least one of the plurality of liquid developing material components further includes the charge director.

13. An apparatus for developing an electrostatic latent image on an image bearing surface with a liquid developing material including a plurality of liquid developing material components, comprising:

a digital image processing system for generating digital signals corresponding to individual picture elements making up an input image to produce the latent electrostatic image on the image bearing surface; and a liquid developing material replenishment control system for determining an amount of at least one of the plurality of liquid developing material components consumed in developing the latent electrostatic image as a function of a number of the individual picture elements making up the input image and for controlling an amount of the at least one of the plurality of liquid developing material components to be added to the liquid developing material as a function of the number of the individual picture elements making up the input image.

14. The developing apparatus of claim 13, further including:

a liquid developing material applicator adapted for transporting liquid developing material into contact with the image bearing surface; and a supply reservoir coupled to said liquid developing material applicator for storing a supply of the liquid developing material and delivering the liquid developing material to said liquid developing material applicator.

15. The developing apparatus of claim 14, further including means, responsive to said control system, for dispensing at least one of the plurality of liquid developing material components into said supply reservoir.

16. The developing apparatus of claim 15, wherein:

the plurality of liquid developing material components includes at least a liquid carrier, marking particles, and charge director; and the at least one of the plurality of liquid developing material components includes the charge director.

17. The developing apparatus of claim 15, wherein:

the plurality of liquid developing material components includes at least a liquid carrier, marking particles, and charge director; and the at least one of the plurality of liquid developing material components includes the marking particles.

18. The developing apparatus of claim 17, wherein the at least one of the plurality of liquid developing material components further includes the charge director.

19. The developing apparatus of claim 13, further including a developing roll situated adjacent said liquid developing material applicator and downstream therefrom relative to a path of travel of the image bearing surface.

20. The developing apparatus of claim 19, further including means for electrically biasing said developing roll for attracting the liquid developing material to image areas of the electrostatic latent image.

21. The developing apparatus of claim 19, further including means for rotating said developing roll in a direction opposite the path of travel of the image bearing surface to create a shear force for minimizing a thickness of the liquid developing material thereon.

22. An electrostatographic printing process, comprising the steps of:

generating a digital data signal representing individual picture elements making up an input image to produce a latent electrostatic image on an imaging surface;

applying a liquid developing material to said imaging surface for developing the latent electrostatic image, the liquid developing material including a plurality of liquid developing material components;

counting the number of picture elements contained in the digital data signal;

determining an amount of at least one of the plurality of liquid developing material components consumed in developing the latent electrostatic image consumed in said developing step as a function of the number of picture elements making up the latent electrostatic image; and dispensing a selected amount of the at least one of the plurality of liquid developing material components into the liquid developing material in response to said counting step.

23. The electrostatographic printing process of claim 22, wherein:

the plurality of liquid developing material components includes at least a liquid carrier, marking particles, and charge director; and the at least one of the plurality of liquid developing material components includes the charge director.

24. The electrostatographic printing process of claim 22, wherein:

the plurality of liquid developing material components includes at least a liquid carrier, marking particles, and charge director; and the at least one of the plurality of liquid developing material components includes the marking particles.

25. The electrostatographic printing process of claim 24, wherein the at least one of the plurality of liquid developing material components further includes the charge director.

26. The electrostatographic printing process of claim 22, further including the steps of:

determining a color value for each individual picture element; and determining, in response to said color value determining step, a color picture element count corresponding to each color value.

* * * * *